US009539786B2

(12) United States Patent
Marshall

(10) Patent No.: US 9,539,786 B2
(45) Date of Patent: Jan. 10, 2017

(54) CONTAINER HAVING A STACKING SUPPORT SHAPING

(75) Inventor: Neil Marshall, Fareham Hants (GB)

(73) Assignee: HUHTAMÄKI OYJ, Espoo (FI)

( * ) Notice: Subject to any disclaimer, the term of this patent is extended or adjusted under 35 U.S.C. 154(b) by 824 days.

(21) Appl. No.: 13/513,534

(22) PCT Filed: Dec. 2, 2010

(86) PCT No.: PCT/EP2010/007317

§ 371 (c)(1),
(2), (4) Date: Jun. 1, 2012

(87) PCT Pub. No.: WO2011/066965

PCT Pub. Date: Jun. 9, 2011

(65) Prior Publication Data

US 2012/0241511 A1 Sep. 27, 2012

(30) Foreign Application Priority Data

Dec. 4, 2009 (DE) ..... 10 2009 044 772
Apr. 9, 2010 (DE) ..... 10 2010 016 390
Jul. 6, 2010 (EP) ..... 1006950

(51) Int. Cl.
*B65D 1/44* (2006.01)
*B31B 45/00* (2006.01)
(Continued)

(52) U.S. Cl.
CPC ..... *B31B 45/00* (2013.01); *B31B 1/28* (2013.01); *B31B 17/00* (2013.01); *B65D 3/06* (2013.01);
(Continued)

(58) Field of Classification Search
CPC ..... B31B 45/00; B31B 1/28; B31B 1/26; B31B 1/30; B31B 1/32; B31B 1/34; B31B 17/00; B65D 3/00; B65D 3/02; B65D 3/04; B65D 3/06; B65D 3/08; B65D 3/28
(Continued)

(56) References Cited

U.S. PATENT DOCUMENTS 1,091,526 A * 3/1914 Moore ..... 229/5.5
1,137,039 A * 4/1915 Weber ..... 206/217
(Continued)

FOREIGN PATENT DOCUMENTS

AT 54111 B 2/1991
DE 1432189 2/1969
(Continued)

*Primary Examiner* — Steven A. Reynolds
*Assistant Examiner* — Javier A Pagan
(74) *Attorney, Agent, or Firm* — Husch Blackwell LLP

(57) ABSTRACT

A container having a bottom and a cylindrical or conical sidewall attached to the bottom, wherein the sidewall preferably comprises a rolled rim at its upper edge opposite to the bottom and is produced from a paper- or carton material, wherein at least a first shaping is provided into the sidewall in a first height, and wherein the shaping extends at least partially over the perimeter of the sidewall. A process for the production of a container with a bottom and a conical or cylindrical sidewall is also provided, wherein the bottom and the sidewall are made from a paper- or cardboard-material and a first circumferential shaping is inserted into the sidewall.

12 Claims, 1 Drawing Sheet

(51) Int. Cl.

| | |
|---|---|
| ***B31B 1/28*** | (2006.01) |
| ***B31B 17/00*** | (2006.01) |
| ***B65D 3/06*** | (2006.01) |
| ***B65D 3/28*** | (2006.01) |
| ***B65D 81/38*** | (2006.01) |
| ***B65D 85/816*** | (2006.01) |

(52) U.S. Cl.
CPC ..... *B65D 3/28* (2013.01); *B65D 81/3869* (2013.01); *B65D 85/816* (2013.01); *B31B 2201/2604* (2013.01); *B31B 2201/2654* (2013.01); *B31B 2201/2695* (2013.01); *B31B 2217/062* (2013.01); *B31B 2217/064* (2013.01); *B31B 2217/082* (2013.01)

(58) Field of Classification Search
USPC ..... 220/62.19–62.2, 651–654, 669–674; 229/400–405
See application file for complete search history.

(56) References Cited

U.S. PATENT DOCUMENTS

| | | | | | |
|---|---|---|---|---|---|
| 1,571,208 | A | * | 2/1926 | Lindgren | 220/62.2 |
| 2,028,566 | A | * | 1/1936 | Seipel et al. | 294/31.2 |
| 2,090,435 | A | * | 8/1937 | Waldvogel | 206/592 |
| 2,139,143 | A | * | 12/1938 | Wiswell | 222/82 |
| 2,266,828 | A | * | 12/1941 | Sykes | 220/1.5 |
| 2,591,578 | A | * | 4/1952 | McNealy et al. | 229/403 |
| 2,622,051 | A | * | 12/1952 | Hermanson et al. | 428/154 |
| 2,816,697 | A | * | 12/1957 | Amberg | 229/400 |
| 2,905,350 | A | * | 9/1959 | Edwards | 215/373 |
| 3,079,027 | A | * | 2/1963 | Edwards | 206/519 |
| 3,157,335 | A | * | 11/1964 | Maier | 229/400 |
| 3,186,850 | A | * | 6/1965 | Anthony | 426/86 |
| 3,208,631 | A | * | 9/1965 | Edwards | 206/519 |
| 3,223,305 | A | * | 12/1965 | Edwards | 229/400 |
| 3,288,340 | A | | 11/1966 | Shapiro et al. | |
| 3,372,830 | A | * | 3/1968 | Edwards | 206/519 |
| 3,456,860 | A | * | 7/1969 | Janninck | 229/400 |
| 3,472,418 | A | * | 10/1969 | Ullman | 220/672 |
| 3,495,736 | A | * | 2/1970 | Ragettli | 220/670 |
| 3,512,677 | A | * | 5/1970 | Kovac | 206/520 |
| 3,519,165 | A | * | 7/1970 | Hawley | 206/519 |
| 3,526,316 | A | * | 9/1970 | Kalogris | 206/217 |
| 3,927,766 | A | | 12/1975 | Day | |
| 4,040,537 | A | * | 8/1977 | Edwards | 206/520 |
| 4,156,483 | A | * | 5/1979 | Day | 206/217 |
| 4,237,939 | A | * | 12/1980 | Schwarz | 138/109 |
| 4,324,340 | A | * | 4/1982 | Belokin, Jr. | 220/667 |
| 4,368,818 | A | * | 1/1983 | Day et al. | 206/217 |
| 4,373,634 | A | * | 2/1983 | Edwards | 206/520 |
| 4,420,081 | A | * | 12/1983 | Dart | 206/519 |
| 4,548,349 | A | * | 10/1985 | Tunberg | 229/800 |
| 4,609,113 | A | * | 9/1986 | Seki | 215/382 |
| 4,657,141 | A | * | 4/1987 | Sorensen | 206/519 |
| 4,993,580 | A | * | 2/1991 | Smith | 220/1.5 |
| RE33,608 | E | * | 6/1991 | Sorensen | 206/519 |
| 5,125,512 | A | * | 6/1992 | O'Leary | 206/517 |
| 5,397,021 | A | * | 3/1995 | Usui | 220/667 |
| 5,415,339 | A | * | 5/1995 | Howard | 229/403 |
| 5,490,631 | A | * | 2/1996 | Iioka et al. | 229/403 |
| 5,669,553 | A | * | 9/1997 | Smith | 229/403 |
| 5,725,916 | A | * | 3/1998 | Ishii et al. | 428/34.2 |
| 5,766,709 | A | * | 6/1998 | Geddes et al. | 428/35.7 |
| 5,769,311 | A | * | 6/1998 | Morita et al. | 229/403 |
| 5,772,111 | A | * | 6/1998 | Kirsch | 229/403 |
| 5,820,016 | A | * | 10/1998 | Stropkay | 229/403 |
| 5,911,360 | A | * | 6/1999 | Schellenberg | 229/404 |
| 5,950,917 | A | * | 9/1999 | Smith | 229/403 |
| 5,964,400 | A | * | 10/1999 | Varano et al. | 229/403 |
| 6,039,682 | A | * | 3/2000 | Dees et al. | 493/58 |
| 6,186,394 | B1 | * | 2/2001 | Dees et al. | 229/122.34 |
| 6,193,098 | B1 | * | 2/2001 | Mochizuki et al. | 220/592.17 |
| 6,224,954 | B1 | * | 5/2001 | Mitchell et al. | 428/34.2 |
| 6,253,995 | B1 | * | 7/2001 | Blok et al. | 229/403 |
| 6,260,756 | B1 | * | 7/2001 | Mochizuki et al. | 229/402 |
| 6,287,247 | B1 | * | 9/2001 | Dees et al. | 493/58 |
| 6,497,338 | B1 | * | 12/2002 | Stolzman | 220/628 |
| 6,536,657 | B2 | * | 3/2003 | Van Handel | 229/403 |
| 6,554,154 | B1 | * | 4/2003 | Chauhan et al. | 220/671 |
| 6,586,075 | B1 | * | 7/2003 | Mitchell et al. | 428/159 |
| 6,588,654 | B2 | * | 7/2003 | Nakashima | 229/402 |
| 6,598,786 | B1 | * | 7/2003 | Guo | 229/403 |
| 6,663,926 | B1 | * | 12/2003 | Okushita et al. | 428/34.2 |
| 6,729,534 | B2 | * | 5/2004 | Van Handel | 229/403 |
| 6,926,197 | B2 | * | 8/2005 | Hed et al. | 229/403 |
| 7,100,770 | B2 | * | 9/2006 | D'Amato | 206/505 |
| 7,175,585 | B2 | * | 2/2007 | Okushita et al. | 493/269 |
| 7,281,649 | B2 | * | 10/2007 | Pyper, Jr. | 229/400 |
| 7,458,504 | B2 | * | 12/2008 | Robertson et al. | 229/403 |
| 7,464,856 | B2 | * | 12/2008 | Van Handel | 229/403 |
| 7,464,857 | B2 | * | 12/2008 | Van Handel | 229/403 |
| 7,481,356 | B2 | * | 1/2009 | Stahlecker | 229/403 |
| 7,600,669 | B2 | * | 10/2009 | Van Handel | 229/403 |
| 7,618,359 | B2 | * | 11/2009 | Okushita et al. | 493/155 |
| 7,677,435 | B2 | * | 3/2010 | Stahlecker | 229/403 |
| 7,699,216 | B2 | * | 4/2010 | Smith et al. | 229/403 |
| 7,905,821 | B2 | * | 3/2011 | Stahlecker | 493/152 |
| 7,922,071 | B2 | * | 4/2011 | Robertson et al. | 229/403 |
| 7,993,254 | B2 | * | 8/2011 | Robertson et al. | 493/111 |
| 8,006,861 | B2 | * | 8/2011 | Kim | 220/737 |
| 8,146,796 | B2 | * | 4/2012 | D'Amato | 206/505 |
| 8,172,127 | B2 | * | 5/2012 | Frost et al. | 229/403 |
| 8,360,263 | B2 | * | 1/2013 | D'Amato | 220/592.17 |
| 8,387,857 | B2 | * | 3/2013 | Messerschmid | 229/403 |
| 8,393,886 | B2 | * | 3/2013 | D'Amato | 425/387.1 |
| 2002/0130170 | A1 | * | 9/2002 | Nakashima | 229/402 |
| 2003/0015582 | A1 | * | 1/2003 | Handel | 229/403 |
| 2003/0121189 | A1 | * | 7/2003 | Williams | 40/324 |
| 2003/0121963 | A1 | * | 7/2003 | Van Handel | 229/403 |
| 2004/0094612 | A1 | * | 5/2004 | D'Amato | 229/403 |
| 2004/0226948 | A1 | * | 11/2004 | Okushita et al. | 220/62.18 |
| 2005/0040218 | A1 | * | 2/2005 | Hinchey et al. | 229/403 |
| 2005/0258225 | A1 | * | 11/2005 | Martin | 229/403 |
| 2006/0027640 | A1 | * | 2/2006 | Smith et al. | 229/400 |
| 2006/0118608 | A1 | * | 6/2006 | Stahlecker | 229/403 |
| 2006/0237465 | A1 | * | 10/2006 | D'Amato | 220/592.27 |
| 2007/0117702 | A1 | * | 5/2007 | Okushita et al. | 493/155 |
| 2007/0228134 | A1 | * | 10/2007 | Cook et al. | 229/403 |
| 2008/0023537 | A1 | * | 1/2008 | Frost et al. | 229/400 |
| 2008/0029588 | A1 | * | 2/2008 | Messerschmid et al. | 229/400 |
| 2008/0087715 | A1 | * | 4/2008 | Robertson et al. | 229/403 |
| 2008/0090711 | A1 | * | 4/2008 | Robertson et al. | 493/111 |
| 2008/0121681 | A1 | * | 5/2008 | Wiedmeyer | 229/403 |
| 2008/0128481 | A1 | * | 6/2008 | Robertson | 229/403 |
| 2008/0290103 | A1 | * | 11/2008 | Robertson et al. | 220/737 |
| 2009/0321460 | A1 | * | 12/2009 | Kim | 220/738 |
| 2009/0321508 | A1 | * | 12/2009 | Fu et al. | 229/403 |
| 2011/0174656 | A1 | * | 7/2011 | D'Amato | 206/505 |

FOREIGN PATENT DOCUMENTS

| | | | | | |
|---|---|---|---|---|---|
| DE | 8601943.0 | U1 | | 3/1986 | |
| DE | 102004056932 | A1 | | 5/2006 | |
| EP | 1785265 | A1 | * | 5/2007 | B31B 17/00 |
| EP | 2272658 | A2 | | 1/2011 | |
| EP | 2272660 | A2 | | 1/2011 | |
| FR | 2624098 | A1 | | 6/1989 | |
| GB | 1480545 | | | 7/1977 | |
| GB | 2333754 | A | | 8/1999 | |
| GB | 2452719 | A | | 3/2009 | |
| WO | 2007054179 | A2 | | 5/2007 | |

* cited by examiner

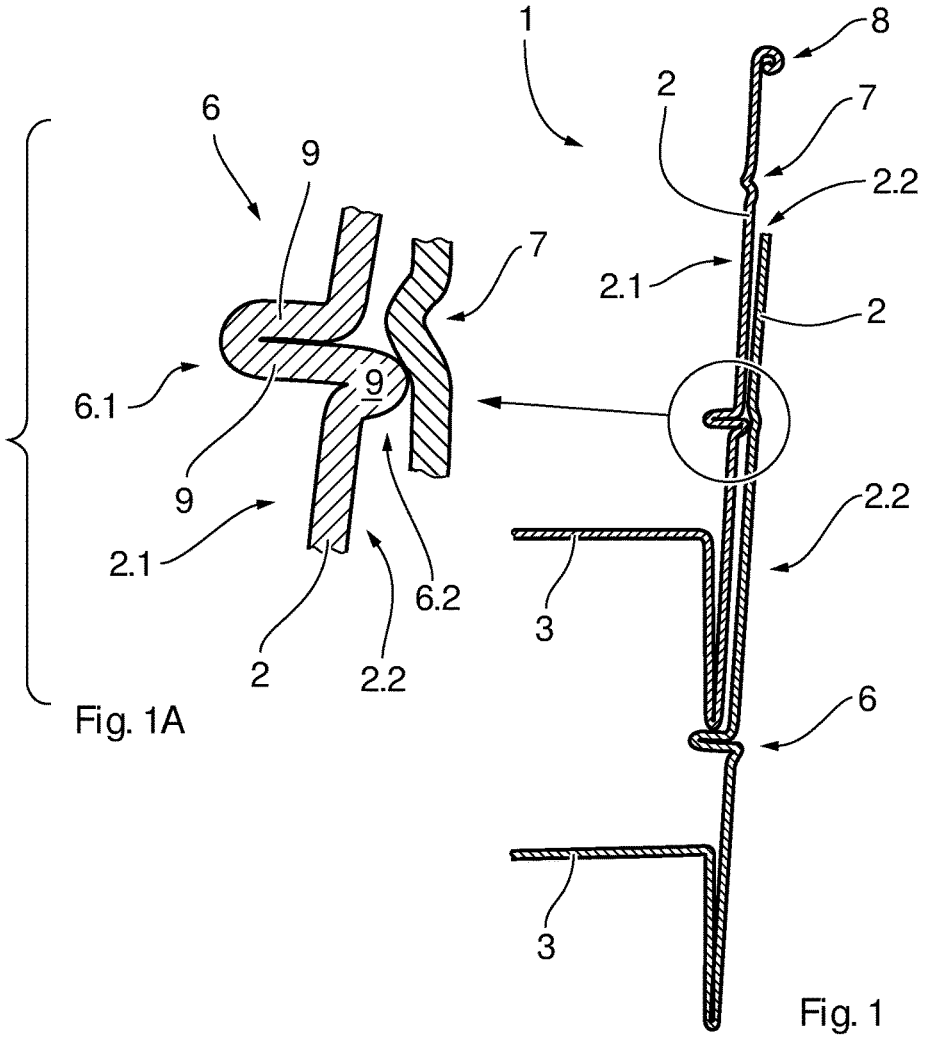
Fig. 1A
Fig. 1
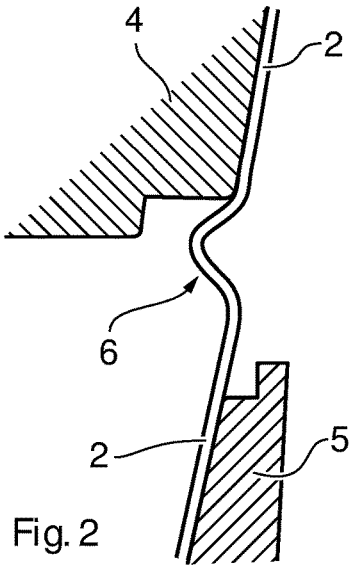
Fig. 2
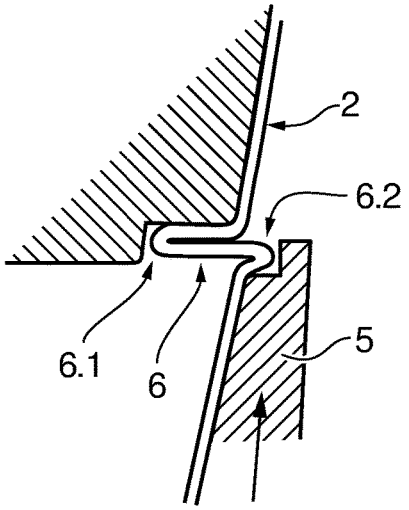
Fig. 3

CONTAINER HAVING A STACKING SUPPORT SHAPING

CROSS-REFERENCE TO RELATED APPLICATIONS

None.

FIELD OF THE INVENTION

The present invention relates to a container having a bottom and a cylindrical or conical sidewall attached to the bottom, wherein the sidewall preferably comprises a rolled rim at its upper edge opposite to the bottom and is produced from a paper- or carton material, whereas at least a first shaping is provided into the sidewall in a first height (h1), wherein the shaping extends at least partially over the perimeter of the sidewall. The present invention further relates to a process for the production of a container with a bottom and a conical or cylindrical sidewall, whereas the bottom and the sidewall are made from a paper- or cardboard-material and a first circumferential shaping is inserted into the sidewall.

BACKGROUND OF THE INVENTION

Containers, for example cups, are well known, for example from DE-OS 1 432 189, DE 10 2004 056 932 A1, WO 2007/054179 A2, DE 54111, DE 86 01 943 U1, GB 1 480 545 and DE 3 927 766. However, these container have deficiencies regarding stackability.

SUMMARY OF THE INVENTION

It is therefore the object of the present invention, to provide a container with improved stackability-features.

The problem is addressed with a container having a bottom and a cylindrical or conical sidewall attached to the bottom, wherein the sidewall preferably comprises a rolled rim at its upper edge opposite to the bottom and is produced from a paper- or carton material, whereas at least a first shaping is provided into the sidewall in a first height, wherein the shaping extends at least partially over the perimeter of the sidewall, whereas the shaping is compressed in its height such that it is essentially flat and that it has at least a first portion, which extends from the inner side of the sidewall and a second portion that extend from the outer side of the sidewall This container is particularly a cup in which beverages, especially hot beverages such as coffee or tea or food especially soup can be served. The container is made from paper, thick paper and/or cardboard. Preferably the material is plastically deformable, preferably embossable and more preferably also elastically deformable. Particularly the sidewall can be multilayered.

All parts of the inventive containers are made from this paper- and/or cardboard-material, whereas the individual parts of the container can be made from different materials. Especially the surfaces of the parts of the container that are subjected to a liquid and/or vapor are preferably provided with means, especially a coating, an impregnation, a film or the like which makes these parts at least temporarily resistant against for example humidity, water, aqueous solutions, oil and/or fat or a combination thereof. Preferably the above mentioned means are also heat sealable. The material can also comprise a heat sealable coating, especially on its inner side.

The container according to this present invention comprises a sidewall, which is conically or cylindrically shaped and which preferably has at its upper end a rolled rim. The sidewall is preferably made from a flat segment, which is subsequently formed, preferably rolled, into its conical shape. Preferably at its lower end, the sidewall is connected to a bottom in order to close the container at the base. The bottom is preferably a separate part which is attached, more preferably glued or heat sealed to the lower end of the sidewall of the container. The sidewall and the base define a filling-volume, which can be filled with a product.

The shaping(s) can be produced by any technique known by a person skilled in the art, e.g. by folding or any other method of plastic deformation. Preferably, the shaping(s) is/are inserted into the flat segment before it is formed, e.g. rolled into the final shape of the sidewall. More preferably, the shaping(s) is/are an embossment, respectively, which is/are produced for example by applying locally pressure to the sidewall and deforming the material of the sidewall plastically. The shaping can have any shape known by a person skilled in the art. However it must be compressible, at least partially, especially in case an axial-force is applied to the sidewall. Preferably the shaping is U-shaped or has partially the shape of a segment of a circle. The shaping can be directed inwardly, i.e. towards the filling-volume of the container and/or outwardly, i.e. away from the filling-volume of the container, whereas an outwardly directed shaping is preferred. The sidewall can comprise a multitude of shapings above each other. Each shaping can extend entirely or only partially around the perimeter of the sidewall.

This shaping is now according to the present invention, compressed in its height extension, i.e. after the compression of the shaping, the sidewall is reduced in its height, preferably until the shaping is essentially flat. Due to the compression of the first shaping in its height, this shaping comprises at least a first portion which extends from the inner side of the sidewall, i.e. into the filling volume, and a second portion that extends from the outer side of the sidewall. Both portions preferably originate from one single shaping and are formed during the compression of the shaping in its height. Preferably, both portions of the shaping are U shaped, preferably each with two flanks, that touch each other, preferably lie on each other. Preferably, the two portions have one common flank in the middle. More preferably, this flank is the longest of all flanks of the compressed shaping. More preferably, the flanks are attached to each other. Preferably, the first portion is at least partially below the second portion.

According to a preferred embodiment of the present invention, the shaping, the shaping-dies and/or the compressing tools are capable to generate a compressed shaping with a void. By means of such a void volume it is possible to realize a very good insulating effect.

According to the present invention, it is, furthermore, preferred that the shaping, the shaping dies and/or the compressing tools provide capability to generate a flat profile after the compression. Thereby, an exceptionally high rigidity is realized. Besides, the flat profile has the advantage that it can be used as a stop or spacer.

According to the present invention it is, furthermore, preferred that the shaping is heated up for example by means of ultrasonic sound, laser or any other heat sources and, thereby, simplify for the compression. It has turned out that a heated shaping can be compressed with little effort.

According to the present invention, it is, furthermore, preferred that the edges and/or the flanks of the shaping are joined together preferably by means of heat bonding and/or cold bonding, by means of sealing, gluing or by any other joining technique, whereas also mechanical joining techniques are included. Thereby, it is assured that the compression does not resume at least partially its uncompressed state.

According to a preferred embodiment of the present invention, a coating is applied at least in the region of the edges of the shaping, wherein the coating preferably comprises a heat sealable material to join the edges.

The coating is, e.g. polyethylene. Thereby, the coated region is not only impermeable to fluids but it is also possible to seal for example the edges of the compressed shaping together. Preferably, the sealable material is produced from renewable resources. Furthermore, it is preferred that the coating is applied to the entire surface or to parts of the surface, at least the surface that is exposed to water, a watery substance, oil and/or humidity. A coating that is applied on the entire surface can also provide a protection against fluids and moisture.

According to the present invention, it is, furthermore, preferred that the compressed shaping increases the rigidity of the sidewall. Thereby, it is possible that the sidewall is exceptionally solid and rigid without the need to considerably increase the amount of used material.

According to the present invention, it is furthermore preferred that the shapings are formed as circumferential rings and/or ring segments According to a further preferred embodiment of the present invention, the first shaping is arranged close to the bottom of the container and serves as stacking support, wherein the shaping is preferably inwardly directed. Using such a stacking support, it is possible to avoid that a plurality of cups stacked into one another are pushed together in such a way that they can be hardly or not separated from each other anymore. Such a stacking support is especially advantageous, if a stack of cups is intended to be separated from each other automatically.

Preferably, the inventive container comprises at least one second shaping, which is arranged above the first shaping. This shaping can be compressed in its height or not. Preferably, during stacking of a first and a second container, the second portion of the first shaping of a first container is in form-fit-connection with the second shaping of second container. This embodiment of the present invention has the advantage that a certain defined force is needed to separate two inventive containers from each other.

Thus, the present invention is also directed to a stack of container, whereas the individual containers can be staked into each other and whereas, during stacking of a first and a second container, the second portion of the first shaping of a first container is in form-fit connection with the second shaping of second container. The second portion of the first shaping of the first container preferably snaps into and/or under the second shaping of the second container.

According to a further embodiment of the present invention, it is preferred that a plurality of shapings are used which are arranged side by side in vertical direction of the container, wherein towards the bottom the shapings have preferably a smaller radial extension. Thereby, the stackability is significantly improved and/or the stacking height is reduced. Each shaping can be compressed or not. This compression of the shaping is preferably carried out with a pusher that is preferably located in the vicinity of the bottom of the container and is axially displaced towards and away from the container and thus compresses the shaping in the sidewall of the container. Each shaping may comprise a first and second shaping as described above.

According to the present invention, it is, furthermore, preferred that the compressed shaping forms a high-frictional grip area. Thereby, it is possible that even for a single-sidewall cup a well-insulated and grippable grip area is realized, wherein a slipping is effectively avoided due to the surface property and surface texture.

According to the present invention, it is furthermore preferred that the cup comprises a second sidewall, wherein the second sidewall can be single-layered or multi-layered, wherein the second sidewall is wrapped around the first sidewall or wherein the second sidewall is pulled over the first sidewall. The two sidewalls are preferably attached to each other, for example by gluing, sealing or mechanically. Thereby, it is possible that the outer sidewall snaps into place and is, thereby, tightly attached to the inner sidewall.

The shaping functions in this preferred embodiment preferably also a spacer between the first and the second sidewall, especially to maintain an air gap between the first and the second sidewall, even if the second sidewall is subjected to pressure, for example by the hand of a user.

The second sidewall can be utilized to maintain the shapings in their compressed state, so that the fill line appears as a fine line. Thereto, the two sidewalls are preferably connected in two or more different areas, especially at two or more different heights of the container. The shaping itself or other parts of the first sidewall can be connected to the second sidewall. The second sidewall hinders the compressed shaping to resume its original shape after the compression force has been released.

Another subject matter of the present invention is a process for the production of a container with a bottom and a conical or cylindrical sidewall, whereas the bottom and the sidewall are made from a paper- or cardboard-material and a first circumferential shaping is inserted into the sidewall, whereas this shaping is subsequently compressed such, that a first portion of the shaping extends from the inner side of the sidewall and a second portion extends from the outer side of the sidewall.

The disclosure made regarding the inventive container also applies to the inventive process and vice versa.

Preferably, during the compression of the shaping a flat profile is generated.

Preferably, the edges of the shaping are joined together by means of heat bonding or cold bonding, by means of hot sealing or by any other joining technique.

The inventions are now explained in further detail according to FIGS. 1 and 2. These explanations do not limit the scope of protection.

DESCRIPTION OF THE SEVERAL VIEWS OF THE DRAWING

FIG. 1 is a partial sectional view of two stacked containers.

FIG. 1A is an enlarged partial sectional view of FIG. 1 illustrating a first shaping of one container in form-fit connection with a second shaping of another container.

FIG. 2 illustrates the compression process of the shaping.

FIG. 3 illustrates the compression process of the shaping.

DETAILED DESCRIPTION OF THE INVENTION

FIG. 1 shows two containers 1, which are stacked. Each container comprises a conical side wall 2, which has at its upper end a rim 8 and at its lower end a bottom 3 which is attached, preferably sealed, to the side wall. Above the bottom 3 and relatively close to the bottom, a first shaping 6 is inserted into the side wall. This inserting 6 comprises a first portion 6.1 which extends from the inner surface 2.1 of the side wall and a second portion 6.2, which extend from the outer surface 2.2 of the side wall. Each portion 6.1, 6.2 comprises two flanks 6, which are preferably, at least essentially, parallel to each other, whereas at least two flanks, preferably two flanks 9 of each portion, are, at least locally, connected, preferably sealed or glued, together. The first portion 6.1 of the shaping 6 is preferably, at least partially located above the second portion 6.2 of the shaping. Both shapings have preferably a common flank, which is the longest flank of the first shaping 6. Above the first shaping, a second shaping 7 is introduced into the side wall 2. After one container has been inserted into a second container, the first portion 6.1 preferably builds a stop, which limits the degree by which the second container can be inserted into the first container. The second portion 6.2 form-fits together with the second shaping 7 so that a certain force is needed to remove one container from the other. This form-fit is depicted in the enlarged view of FIG. 1A. It can be clearly seen that at least the tip of the second portion 6.2 of the first shaping 6 lies against the lower edge of the second shaping 7 and thus forms a form-fit. During insertion and/or removal of the first container in/from the second container, the second portion 6.2 and/or the second shaping 7 slightly deform, preferably elastically, so that the first container is locked in or can be taken out of the second container.

FIGS. 2 and 3 show the compression of a first shaping 6 by a mandrel 4 and a pusher 5. This pusher lies against the bottom and/or the lower tip of side wall 2 and its upward movement compresses the side wall as depicted in FIG. 3. During this compression, a shaping 6, which was initially bended inwards, is shaped into a first inward directed portion 6.1 and a second outwardly directed portion 6.2.

LIST OF REFERENCE SIGNS

1 cardboard container, cup
2 sidewall
2.1 inner side, inner surface of the sidewall
2.2 outer side, outer surface of the sidewall
3 base, bottom
4 mandrel
5 pusher
6 first shaping
6.1 first portion of the first shaping
6.2 second portion of the first shaping
7 second shaping
8 rolled rim
9 flank

The invention claimed is:

1. A container comprising:

a bottom;

a cylindrical or conical sidewall attached to the bottom, wherein the sidewall includes a rolled rim at an upper edge opposite the bottom and is produced from a paper or cardboard material, wherein the sidewall includes an inner side and an outer side; and a first shaping provided into the sidewall at a first height so that the first shaping is positioned close to the bottom of the container, wherein the first shaping extends at least partially around a perimeter of the sidewall;

wherein the first shaping includes a first flank and a second flank that are compressed in height such that the first shaping is essentially flat;

wherein the first shaping includes a first portion that extends from the sidewall in an inward direction and beyond the inner side of the sidewall and a second portion that extends from the sidewall in an outward direction and beyond the outer side of the sidewall, wherein when the container is a first said container, the first portion of the first shaping serves as stacking support for a second said container when the second said container is partially inserted into the first said container.

2. Container according to claim 1, wherein the first flank is located at least partially above the second flank.

3. Container according to claim 1, wherein a second compressed shaping above the first shaping is provided, which extends at least partially around the perimeter of the sidewall.

4. Container according to claim 1, wherein the first and second flanks of the first shaping are at least partially fixed together.

5. Container according to claim 1, wherein the sidewall is coated with a heat-sealable material.

6. Container according to claim 1, wherein the first shaping forms a high-frictional grip area.

7. Container according to claim 1, wherein the second portion serves as form-fit-means to secure the second said container to the first said container.

8. Container according to claim 7, wherein the second portion of the first shaping of the first said container is in form-fit-connection with a second shaping of the second said container.

9. Container according to claim 1, wherein the first portion of the first shaping is at least partially located above the second portion of the first shaping.

10. Container according to claim 1 further comprising a third flank, wherein the first portion of the first shaping includes the first and second flanks, and wherein the second portion of the first shaping includes the second and third flanks.

11. Container according to claim 10, wherein the first flank is located at least partially above the second flank, and wherein the second flank is located at least partially above the third flank.

12. Container according to claim 1, wherein the first portion of the first shaping of the first said container supports a lowermost end of the second said container when the second said container is at least partially inserted into the first said container.

* * * * *